United States Patent [19]

Sagou et al.

[11] Patent Number: 4,732,828

[45] Date of Patent: Mar. 22, 1988

[54] METHOD FOR FORMING A PHOSPHOR SCREEN OF A CATHODE RAY TUBE

[75] Inventors: Seiji Sagou; Takeo Itou, both of Fukaya, Japan

[73] Assignee: Kabushiki Kaisha Toshiba, Kawasaki, Japan

[21] Appl. No.: 927,106

[22] Filed: Nov. 5, 1986

[30] Foreign Application Priority Data

Nov. 8, 1985 [JP] Japan ..... 60-248904

[51] Int. Cl.[4] ..... G03C 5/00; B05D 5/06

[52] U.S. Cl. ..... 430/28; 427/55; 427/68; 427/71; 427/205; 427/207.1; 427/208.2; 427/314; 427/331; 427/385.5; 430/291

[58] Field of Search ..... 427/68, 71, 55, 205, 427/314, 331, 385.5, 208.2, 207.1; 430/28, 291

[56] References Cited

U.S. PATENT DOCUMENTS 4,263,386 4/1981 Datta et al. ..... 427/68

4,564,572 1/1986 Morishita et al. ..... 427/68

*Primary Examiner*—Janyce A. Bell

*Attorney, Agent, or Firm*—Oblon, Fisher, Spivak, McClelland & Maier

[57] ABSTRACT

In a method for a phosphor screen of a cathode ray tube including the steps of forming a photo-tacky layer on a panel of a cathode ray tube, exposing the photo-tacky layer to form an adhesive pattern on the layer, and adhering phosphor powder on the adhesive pattern, in which these exposing and adhering steps are repeated. Before next exposing step, the photo-tacky layer is heated and then exposed after cooled. The heating step prevents the sensitivity of the layer from deterioration occurred by the preceding adhering step.

11 Claims, 7 Drawing Figures

METHOD FOR FORMING A PHOSPHOR SCREEN OF A CATHODE RAY TUBE

BACKGROUND OF THE INVENTION

The present invention relates to a method for forming a phosphor screen of a cathode ray tube, more particularly to an improvement of a phosphor powder coating method.

In a color cathode ray tube, three different phosphors that respectively emit blue, green and red light are coated in a regular array (in a set pattern) in the form of stripes or dots to the inner surface of a panel which displays an image. Conventionally known methods for forming such phosphor coating layers include a phosphor slurry method and a phosphor powder coating method. The phosphor slurry method uses phosphor in a slurry mixed with photoresist material. In forming a phosphor screen, such a method inconveniently uses lot of water for the development.

The phosphor powder coating method recently developed however has a benefit free from such water development. In the powder coating method, as disclosed in Japanese Patent Publication No. 57-20651, for example, a thin layer of an aromatic diazonium salt, or a photo-tacky composition which contains an aromatic diazonium as a photosensitive component and occurs adhesivity on exposure to light is formed on the inner surface of a panel. Phosphor particles are brought into contact with and held in the thin layer of which a sticky surface formed in the exposed portion, and then remaining excess phosphor particles are removed from the thin layer, whereby a patterned phosphor layer is formed.

In this method, first, a photo-sticky or photo-tacky material, i.e. a photosensitive composition containing a diazonium salt, is coated on the inner surface of the panel in the form of an aqueous solution, heated and dried to give a solid thin layer. The usual procedure in this case is that the panel is coated with an aqueous solution of the photosensitive composition while rotating at low speed and subsequently the speed of rotation is increased, so as to throw the photosensitive composition aqueous solution off the panel. Then the coated solution is heated and dried to form a solid thin layer on the panel are effected by an infrared heater, facing the panel and raised the panel temperature to about 50° C. Next, ultraviolet ray irradiation (exposure) is effected through a shadow mask assembled with the panel. In this case, the panel is cooled beforehand to 30°–40° C., this being done to prevent heat of the panel causing heating and thermal expansion of the shadow mask and consequent shift of positions at which exposure is to be effected. The ultraviolet ray irradiation positions in this process correspond to locations that will be impinged by electron beams in order to cause the phosphor to emit light, i.e., they correspond to locations where the phosphor is to be coated. In a portion of the thin layer where is irradiated by ultraviolet rays, there is produced particle acceptable adhesive surface by diazonium salt photolysis reaction. Next, after the shadow mask is removed, a phosphor powder of a first color is brought into contact with the layer, thereby, causing adhesion of phosphor to an amount corresponding to the positions of the particle acceptable adhesive surface thus obtained. In order to contact such phosphor powder on the adhesive surface a phosphor powder sliding method may be employed. Next, excess phosphor powder is removed from the thin layer by air blow or similar means. In this manner, a first color phosphor layer is formed only on the portions that were exposed. Next, positions where a phosphor powder of a second color is to be fixed are exposed via a shadow mask and the second color phosphor powder is adhered only to the exposed portions in the same manner as forming the first color phosphor. Then a phosphor powder of a third color is adhered to the inner surface of the panel by a similar procedure. The above operation results in a panel on which phosphors of three colors triads constituting a phosphor screen are respectively formed at locations which will be struck by electron beams for causing emission of light. In this method, however, there is the problem that the amount of ultraviolet irradiation energy needed for producing a powder acceptable adhesion region in order to effect adhesion of the second and third colors is 1.5–2 times greater than the corresponding ultraviolet irradiation needed for the first color. In other words, sensitivity is lower with the second color and third color on. Even then the second color and third color adhesion patterns are inferior to the first color pattern and the quality of the second color and third color adhesion patterns is lower. For this reason, in the case that the method applies to coat the phosphor in a minute and precise dot- or stripe-shape on the entire surface of panel of the color cathode ray tube,a part of the phosphor dots peels off or fail to thoroughly thick adhere, as a result, causing to deteriorate the quality of the phosphor screen.

SUMMARY OF THE INVENTION

One object of the present invention is to provide an improved phosphor screen forming method in which deterioration of sensitivity and of phosphor adhesion pattern quality from the second color on are prevented.

According to the invention, the method for forming a phosphor screen of a cathode ray tube comprises the steps of coating a photo-tacky layer on a panel of the cathode ray tube, exposing a surface of the layer to form a pattern of adhesive portions on the layer, and adhering phosphor powder to the pattern and in which the exposing and adhering steps are repeated two times or more, wherein at least a heating before exposure step for heating the photo-tacky layer is positioned after the adhering steps for a first phosphor. In the case of coating three kinds of phosphors respectively emitting blue, green and red for forming a color cathode ray tube phosphor screen, the exposing steps are repeated in three times. The photo-tacky layer is heated before every exposing step. In such a heating before exposure step, it is desired that the photo-tacky layer is heated in the range of 40° C. to 110° C. The layer fails to be activated thoroughly if the layer is at a lower temperature than 40° C. and is decomposed if the layer is heated by a temperature of the layer is over 110° C. The typical material of the photo-tacky layer contains diazonium salt as a main component.

It is desired to use infrared irradiation and, or hot air blow for the heating before exposure step. Consequently in every exposing step after adhering a first phosphor, the photo-tacky layer is activated and the sensitivity recovers about equal to the conditions in a first exposing step. In this manner, the exposure times in the second and the following exposing steps shorten as short as that of the first exposing step. In addition, the adhesive amount of phosphors is thoroughly secured over the whole of the phosphor screen surface, and the screen quality is enhanced. Though the heating before exposure step may be applied to all exposing steps, one heating before exposure step may be applied through the entire steps.

PREFERRED EMBODIMENT OF THE INVENTION

An embodiment will now be described with reference to FIGS. 1–7.

(STEP A)

First, a material which produces the adhesion to adhere powder on being irradiated with ultraviolet rays is of a photosensitive aqueous solution containing
polyvinyl alcohol: 0.5 parts by weight
diazonium salt: 4 parts by weight
surfactant: 0.008 parts by weight
water: balance.

Figure 1:
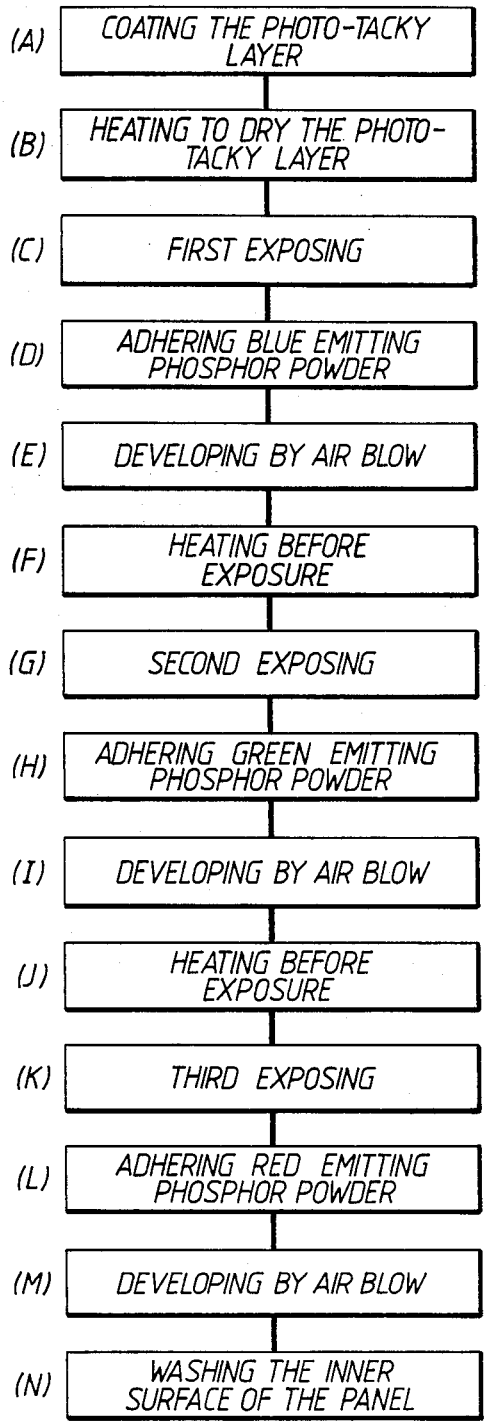
FIG. 1 is a flow-chart showing the steps of one embodiment of the invention.
Figure 2:
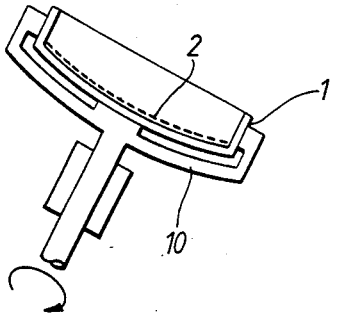
FIGS. 2 to 7 are schematic views illustrating the steps in FIG. 1.
Figure 3:
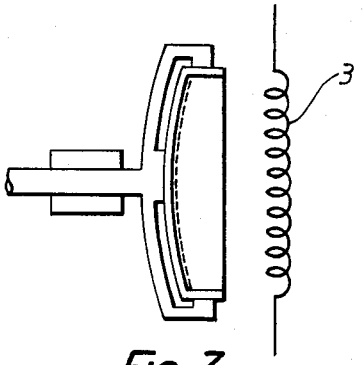

The material is coated to a thickness of about 1 μm on the inner surface of the panel of a 20-inch color cathode ray tube, so forming a photo-tacky layer. In this process, first, the whole of the inner surface of the panel 1, which is rotating at low speed, is wet with the aqueous solution, and then the speed of rotation is increased in order to throw excess aqueous solution off the panel and forma phototacky layer 2 (FIG. 2).

(STEP B)

Next, the panel inner surface was brought facing an infrared heater 3 and the temperature of panel 1 was raised to about 50° C. to effect heating and drying (FIG. 3) and so form dried photo-tacky layer 2 on the panel inner surface.

(STEP C)

Figure 4:
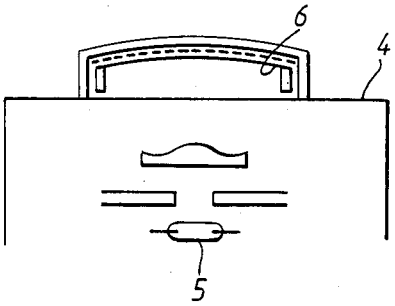
Figure 5:
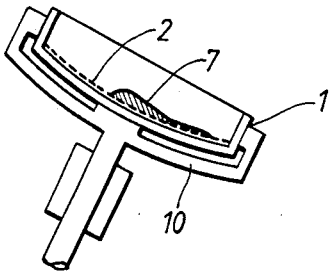

Next, a shadow mask was assembled with the panel and when panel 1 became about 35° C. or less by cooling, it was set on an light house 4 and locations where blue phosphor was to be formed were exposed for about 2 minutes through shadow mask 6 by means of a 1 kW ultrahigh pressure mercury vapor lamp located below the panel inner surface and about 300 mm away from it. Hereupon, a pattern of adhesive surfaces capable of accepting powder was formed in the exposed sites, i.e., the locations where blue phosphor was to be fixed (FIG. 4).

(STEP D)

Next, the shadow mask was removed and about 50 g of ZnS:Ag blue phosphor 7 with an average particle diameter of 5 μm poured onto the panel inner surface and caused to slide over the whole of the panel inner surface (FIG. 5), whereby the blue phosphor adhered to those locations of the panel inner surface to which blue phosphor was to be fixed.

(STEP E)

Figure 6:
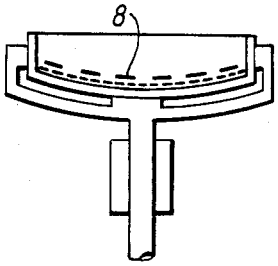

Then, the excess phosphor on unexposed portions was blown off by dry air at about 8.5 m/sec from a spray gun which had seven 0.5 mm diameter nozzle holes at 50 mm intervals and was located about 200 mm from the panel inner surface, thereby effecting so-called air development and forming a set blue phosphor pattern 8 (FIG. 6).

(STEP F)

Figure 7:
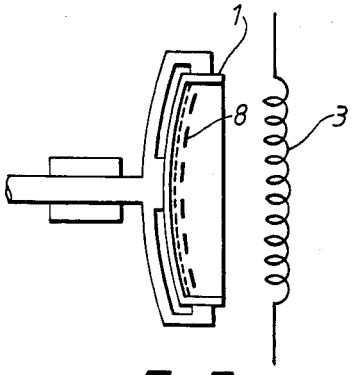

Next, the panel inner surface was brought facing an infrared heater and the panel was heated again to about 50° C. (FIG. 7).

(STEPS G,H AND I)

The panel was assembled with a shadow mask and cooled to about 35° C. or less and, as with the blue phosphor, approximately 2 minute exposure was effected and adhesion of ZnS:CuAl phosphor with an average particle diameter of about 5 μm and air development were effected to form a set ZnS:CuAl gree phosphor pattern.

(STEP J)

Further, as with the Step F, heating was effected.

(Step K,L and M)

After heating, cooling, approximately 2 minute exposure, adhesion of phosphor and air development were effected to form a pattern of $Y_2O_2S$:Eu red phosphor with an average particle diameter of about 5 μm. In this manner, a panel on which phosphors of three color triads, blue, green and red, were adhered was produced.

(STEP N)

Pure water was supplied onto the inner surface of this panel at a pressure of about 1.5 kg/cm$^2$ by a 0.5 mm diameter spray nozzle, to wash excess photo-tacky material and phosphors on the panel inner surface. Examination of the phosphor scree after washing showed that no phosphor had become detached and that there was good balance of the three colors, the amounts of blue, gree and red phosphor adhering being 3.2 mg/cm$^2$, 3.15 mg/cm$^2$ and 3.8 mg/cm$^2$ respectively.

Next, the following test was conducted for the purpose of comparison with the method of the invention. The abovedescribed photosensitive aqueous solution was used and approximately 2 minute exposure was effected for blue, green and red and phosphor layers were formed, but without heating the photo-tacky layer prior to exposure for the second color and third color. When water washing as in the embodiment was effected, the amounts of blue, green and red phosphor adhering were low, at 1.6 mg/cm$^2$, 1.0 mg/cm$^2$ and 0.8 mg/cm$^2$ respectively and there was also found to be detachment of phosphor. The time for achieving the same amount of phosphor adhesion as in the embodiment of the invention was 2 minutes for blue, 3 minutes 10 seconds for green and 3 minutes 45 seconds for red, and also a fixing step by vapor ammonia was necessary.

When the temperature at which the photo-tacky layer was heated prior to exposure for adhesion of the phosphor of the second color was varied, it was found that the amount of phosphor adhering increased at 40° C. and over and reached a peak at 50° C. or more.

Heating the photo-tacky layer is limited by its decomposition. Diazonium salt is capable of heated up to about 110° C.

Air blow also may be used for heating separately or together with the infrared irradiation.

Since air blow elevates the temperature of the thin photo-tacky layer discretely from the panel if the panel is at a room temperature, the photo-tacky layer in the next step is cooled fast and uniformely over the entire surface due to the panel. It is believed that the layer may recover the photo-sensitivity in each of the exposing steps since these heating and cooling steps before exposure step adjust water contained in the photo-tacky layer.

Therefore, it is desired that through a phosphor screeen forming process, air environment may have non-dry air with about 20 % to about 80 % of relative humidity at a room temperature. Dry air however may be used to both of air blow for developing step and hot air blow for heating before exposure step.

Further, although the developing and heating steps are separated as the steps (E) and (F) in the embodiment above described, these steps may be combined in a single step by using hot air in the developing step.

The photo-tacky material, besides the material described in the embodiment, may be used with
p-Diazo-methoxybenzene chloride-zinc chloride,
o-Diazo-methoxybenzene chloride-zine chloride and so on.

As described above, the adoption of the invention makes it possible to prevent the sensitivity of the photo-tacky material from the deterioration on the exposing step for coating a plurality of phosphor on a panel, thereby, a high quality phosphor screen being formed.

The invention is applied to a phosphor screen of a cathode ray tube such as a color cathode ray tube, a cathode ray oscilloscope and the other type cathode ray tubes.

We claim:

1. In a method for forming a phosphor screen of a cathode ray tube comprising the steps of:
coating a photo-tacky layer on a panel of the cathode ray tube;
exposing a surface of the photo-tacky layer to light to form a pattern of adhesive surfaces on the layer; and
adhering phosphor powder to the pattern and in which the exposing and adhering steps are repeated, two times or more, wherein
at least a heating before exposure step for heating the photo-tacky layer to a temperature in the range of 40°–110° C. is contained in the steps after the adhering steps for a first phosphor.

2. The method of claim 1, wherein the heating before exposure step is interposed between a leading step adhering a phosphor and a trailing step exposing.

3. The method of claim 1, wherein the phosphors are three kinds of phosphors emitting blue, green and red respectively, the exposing and adhering steps are repeated in every phosphors.

4. The method of claim 1, wherein the photo-tacky layer contains diazonium salt as a main component.

5. The method of claim 1, wherein the photo-tacky layer is heated at 50° C. or more in the heating before exposure step and the photo-tacky layer is maintained at less than 40° C. in the exposing step.

6. The method of claim 1, wherein the photo-tacky layer is exposed at a lower temperature than that of the heating before exposure step.

7. The method of claim 1, wherein the photo-tacky layer is heated by hot air in the heating before exposure step.

8. The method of claim 1, wherein the photo-tacky layer is heated by infrared irradiation in the heating before exposure step.

9. The method of claim 1, wherein the all steps are performed in an atmosphere of non dry air.

10. A method for forming a phosphor screen of a cathode ray tube comprising the steps of:
coating a photo-tacky layer on a panel of the cathode ray tube;
heating before exposure for heating the phototacky layer to a temperature in the range of 40°–110° C.;
exposing the photo-tacky layer to light to form a pattern of adhesive surfaces on the layer;
contacting and adhering phosphor powder onto the layer; and
removing excess phosphor powder from the panel, wherein the steps except for the coating step are repeated for each phosphor, and in the heating before exposure step the photo-tacky layer is heated higher than a temperature at which the phototacky layer is exposed.

11. A method for forming a phosphor screen of a cathode ray tube comprising the steps of:
coating a photo-tacky layer on a panel of a cathode ray tube;
exposing selectively the photo-tacky layer to light to cause a predetermined pattern of adhesive surfaces on the layer; and
adhering phosphor powder on the adhesive surfaces, the improvement comprising:
(a) a coating step for coating the photo-tacky layer on the panel;
(b) a first exposing step for exposing selectively the photo-tacky layer to light to form the pattern of adhesive surfaces on the layer;
(c) a first adhering step for contacting a first phosphor powder on the adhesive surfaces to adhere thereon;
(d) a heating step for heating the photo-tacky layer to a temperature in the range of 40°–110° C.;
(e) a second exposing step for exposing selectively the photo-tacky layer to light to form a predetermined pattern of adhesive surfaces; and
(f) a second adhering step for contacting a second phosphor powder to adhere on the adhesive surfaces.

* * * * *